US011065892B2

(12) United States Patent
Kobayashi et al.

(10) Patent No.: US 11,065,892 B2
(45) Date of Patent: Jul. 20, 2021

(54) PRINTING APPARATUS AND CONVEYANCE APPARATUS

(71) Applicant: CANON KABUSHIKI KAISHA, Tokyo (JP)

(72) Inventors: Ryo Kobayashi, Fuchu (JP); Yoshiaki Suzuki, Nagareyama (JP); Tsutomu Obata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/831,884

(22) Filed: Mar. 27, 2020

(65) Prior Publication Data

US 2020/0307269 A1 Oct. 1, 2020

(30) Foreign Application Priority Data

Mar. 29, 2019 (JP) ..... JP2019-065976

(51) Int. Cl.

| | |
|---|---|
| ***B65H 9/16*** | (2006.01) |
| ***B41J 11/68*** | (2006.01) |
| ***B41J 11/66*** | (2006.01) |
| ***B41J 2/01*** | (2006.01) |
| ***B41J 13/00*** | (2006.01) |
| ***B41J 11/42*** | (2006.01) |

(52) U.S. Cl.

CPC ..... *B41J 11/663* (2013.01); *B41J 2/01* (2013.01); *B41J 11/42* (2013.01); *B41J 11/68* (2013.01); *B41J 13/0009* (2013.01); *B65H 9/16* (2013.01); *B65H 9/166* (2013.01)

(58) Field of Classification Search

CPC ..... B65H 9/16; B65H 9/166; B41J 11/663; B41J 2/01; B41J 13/0009; B41J 11/42; B41J 11/70; B41J 11/68

See application file for complete search history.

(56) References Cited

U.S. PATENT DOCUMENTS 4,877,234 A * 10/1989 Mandel ..... B65H 9/166 271/225

5,459,580 A 10/1995 Suzuki (Continued)

FOREIGN PATENT DOCUMENTS

JP 62-230545 * 10/1987 ..... B65H 9/16

JP 2006-137601 * 6/2006 ..... B65G 13/00

(Continued)

OTHER PUBLICATIONS

Machine translation of JP 62-230545, published on Oct. 1987.*

Machine translation of JP 2006-137601, published on Jun. 2006.*

*Primary Examiner* — Huan H Tran

(74) *Attorney, Agent, or Firm* — Venable LLP

(57) ABSTRACT

To provide a printing apparatus and a conveyance apparatus that are capable of preventing a cut position to be cut by a cutting unit from deviating, in a printing apparatus in which printing is performed by a printing unit on a printing medium that is conveyed by a conveyance unit and the printing medium is cut by a cutting unit while being conveyed by the conveyance unit and a conveying force apply unit, the sconveying force apply unit is arranged on an outer side relative to the cutting unit and configured to apply a conveying force to the printing medium in a direction outward in a width direction from an upstream to a downstream in a conveyance direction.

14 Claims, 7 Drawing Sheets

(56) References Cited

U.S. PATENT DOCUMENTS

| | | | | |
|---|---|---|---|---|
| 6,581,929 | B2 * | 6/2003 | Hiramitsu | B65H 9/002 271/225 |
| 7,104,216 | B2 | 9/2006 | Suzuki et al. | |
| 7,192,112 | B2 | 3/2007 | Nakanishi et al. | |
| 7,192,114 | B2 | 3/2007 | Suzuki et al. | |
| 7,690,744 | B2 | 4/2010 | Nakanishi et al. | |
| 7,901,022 | B2 | 3/2011 | Nakanishi et al. | |
| 8,419,155 | B2 | 4/2013 | Kawakami et al. | |
| 8,727,526 | B2 | 5/2014 | Yamamoto et al. | |
| 8,783,851 | B2 | 7/2014 | Suzuki et al. | |
| 10,059,545 | B1 * | 8/2018 | Chen | B65H 5/06 |
| 2002/0060417 | A1 * | 5/2002 | Hiramitsu | B65H 9/002 271/227 |
| 2004/0037960 | A1 | 2/2004 | Suzuki et al. | |
| 2013/0208043 | A1 | 8/2013 | Kawakami et al. | |

FOREIGN PATENT DOCUMENTS

| | | | | |
|---|---|---|---|---|
| JP | 2010-177343 | * | 8/2010 | Y02E 10/50 |
| JP | 2017-013438 A | | 1/2017 | |

* cited by examiner

PRINTING APPARATUS AND CONVEYANCE APPARATUS

BACKGROUND OF THE INVENTION

Field of the Invention

The present invention relates to a printing apparatus and a conveyance apparatus that are capable of cutting a conveyed sheet-shaped printing medium.

Description of the Related Art

Japanese Patent Laid-Open No. 2017-13438 discloses a technology related to a conveyance apparatus including a slitter for cutting a printing medium along the conveying direction of the printing medium after printing is performed on the printing medium. Specifically, according to the technology disclosed in Japanese Patent Laid-Open No. 2017-13438, the leading edge of a conveyed printing medium is inserted to the slitter, so that the printing medium is cut along the conveyance direction in accordance with conveyance of the printing medium.

However, the leading edge of the printing medium may float due to cockling, which makes the printing medium wave because of ink application, or the like. Therefore, in the technology disclosed in Japanese Patent Laid-Open No. 2017-13438, there is a possibility that the position of the leading edge to be cut by the slitter undesirably deviates in the direction orthogonal to the conveyance direction.

SUMMARY OF THE INVENTION

The present invention has been made in view of the above problem and provides a printing apparatus and a conveyance apparatus that are capable of preventing the cut position to be cut by a cutting unit from deviating.

In the first aspect of the present invention, there is provided a printing apparatus comprising:

a conveyance unit configured to convey a printing medium in a conveyance direction;

a printing unit configured to print an image on the printing medium that is conveyed by the conveyance unit;

a cutting unit configured to cut the printing medium, which is conveyed by the conveyance unit, along the conveyance direction; and a conveying force apply unit arranged on an outer side relative to the cutting unit in a width direction of the printing medium and configured to nip the printing medium and apply a conveying force to the printing medium, wherein the printing medium is cut by the cutting unit while being conveyed by the conveyance unit and while the conveying force is applied to the printing medium by the conveying force apply unit, and wherein the conveying force apply unit is configured to apply a conveying force to the printing medium in a direction outward in the width direction from an upstream to a downstream of the conveyance direction.

In the second aspect of the present invention, there is provided a conveyance apparatus comprising:

a conveyance unit configured to convey a printing medium in a conveyance direction;

a cutting unit configured to cut the printing medium, which is conveyed by the conveyance unit, along the conveyance direction; and a conveying force apply unit arranged on an outer side relative to the cutting unit in a width direction of the printing medium and configured to nip the printing medium and apply a conveying force to the printing medium, wherein the printing medium is cut by the cutting unit while being conveyed by the conveyance unit and while the conveying force is applied to the printing medium by the conveying force apply unit, and wherein the conveying force apply unit is configured to apply a conveying force to the printing medium in a direction outward in the width direction from an upstream to a downstream of the conveyance direction.

According to the present invention, it is possible to prevent the cut position to be cut by the cutting unit from deviating.

Further features of the present invention will become apparent from the following description of exemplary embodiments with reference to the attached drawings.

DESCRIPTION OF THE EMBODIMENTS

Hereinafter, an explanation is given of embodiments of the present invention with reference to the drawings. The following embodiments do not limit the present invention. Further, every combination of the characteristics explained in the present embodiments is not necessarily essential to the solution means of the present invention. The same reference sign is assigned for explanation of the identical configuration. In addition, relative positions, shapes, and the like, of the constituent elements described in the embodiments are merely examples and are not intended to limit the present invention to the range of the examples.

Figure 1:
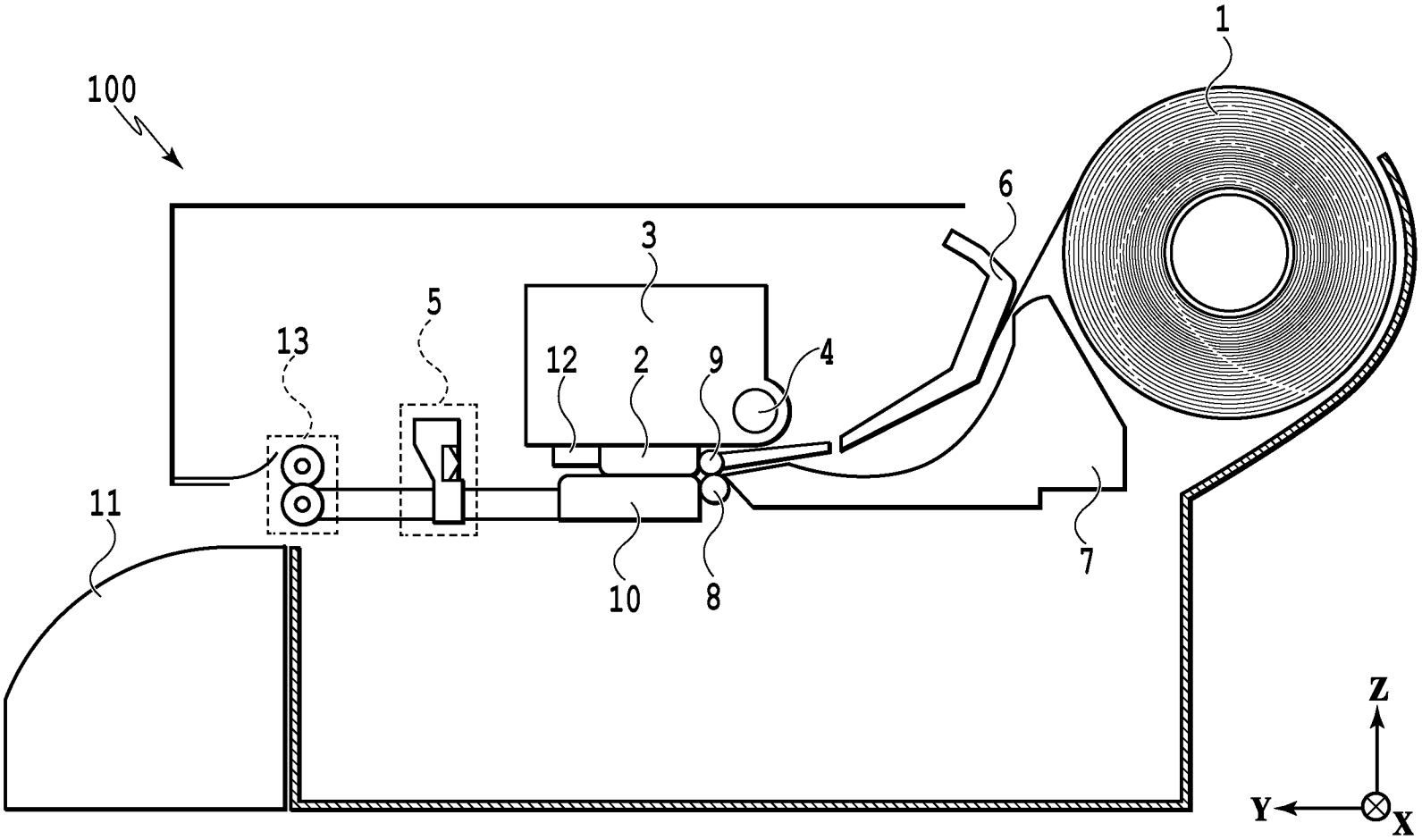
FIG. 1 is a cross-sectional view illustrating a schematic configuration of a printing apparatus.

FIG. 1 is a cross-sectional view illustrating an example of an inkjet printing apparatus according to the present embodiment. The inkjet printing apparatus 100 (hereinafter simply referred to as the printing apparatus 100) performs printing on a printing medium that has a shape of a long sheet. In the present embodiment, the printing medium is a roll sheet 1. The roll sheet 1 held in the printing apparatus 100 is conveyed to the downstream through a conveyance path formed by the upper guide 6 and the lower guide 7. The roll sheet 1 is nipped by the conveyance roller 8 and the pinch roller 9 and conveyed to an image printing unit. The image printing unit is configured to include the print head 2, the carriage 3 on which the print head 2 is mounted, and the platen 10 disposed at a position facing the print head 2. The roll sheet 1 is conveyed onto the platen 10 by the conveyance roller 8. Ink is ejected by the print head 2 onto the roll sheet 1 conveyed to the image printing unit, so as to print an image.

The carriage 3 is supported so as to be able to perform a sliding motion along the guide shaft 4 and a guide rail (not illustrated in the drawing) that are disposed in parallel to each other in the printing apparatus 100. The carriage 3 includes the reflection type detection sensor 12 facing the platen 10, so as to be able to detect the reflectivity of a spot position. That is, in a case where the platen 10 is black and the roll sheet 1 is white, the reflectivity of the platen 10 and the roll sheet 1 are greatly different. Therefore, it is possible to determine whether the platen 10 is present or the roll sheet 1 is present at the spot position by use of the detection sensor 12. It is possible to detect the leading edge of the roll sheet 1 by utilizing the fact that, while the roll sheet 1 is conveyed by the conveyance roller 8, the reflectivity greatly changes in a case where the leading edge of the roll sheet 1 in the conveyance direction passes through the spot position of the detection sensor 12.

The carriage 3 scans in the X direction along the guide shaft 4 while holding the print head 2, and the print head 2 ejects ink while the carriage 3 scans, so as to perform printing on the roll sheet 1. After a scan by the carriage 3 to perform printing on the roll sheet 1, the conveyance roller 8 conveys the roll sheet 1 by a predetermined amount, and the carriage 3 scans on the roll sheet 1 again to perform printing. In this way, by repeating printing and conveying, the entire printing is completed. Furthermore, since the detection sensor 12 is mounted on the carriage 3, the positions of the paper edges in the width direction (X direction) of the roll sheet 1 can also be detected by the reciprocating operation of the carriage 3.

On the downstream relative to the carriage 3 in the conveyance direction of the roll sheet 1, there is provided the cutter 5 for cutting the roll sheet 1 in a direction intersecting the conveyance direction, and, on the further downstream, there is provided the slitter 13 for cutting the roll sheet 1 in the conveyance direction. On the downstream relative to the slitter 13, there is provided the discharging guide 11 for discharging the roll sheet 1 that has been cut.

The cutter 5 includes a cutter unit 300 (see FIG. 2) as a cutting mechanism for cutting the roll sheet 1 and a unit for moving the cutter unit 300 along the X direction. Furthermore, the slitter 13 includes a slitter unit 303 (see FIG. 2) as a cutting mechanism for cutting the roll sheet 1 and a unit for moving the slitter unit 303 along the X direction.

Figure 2:
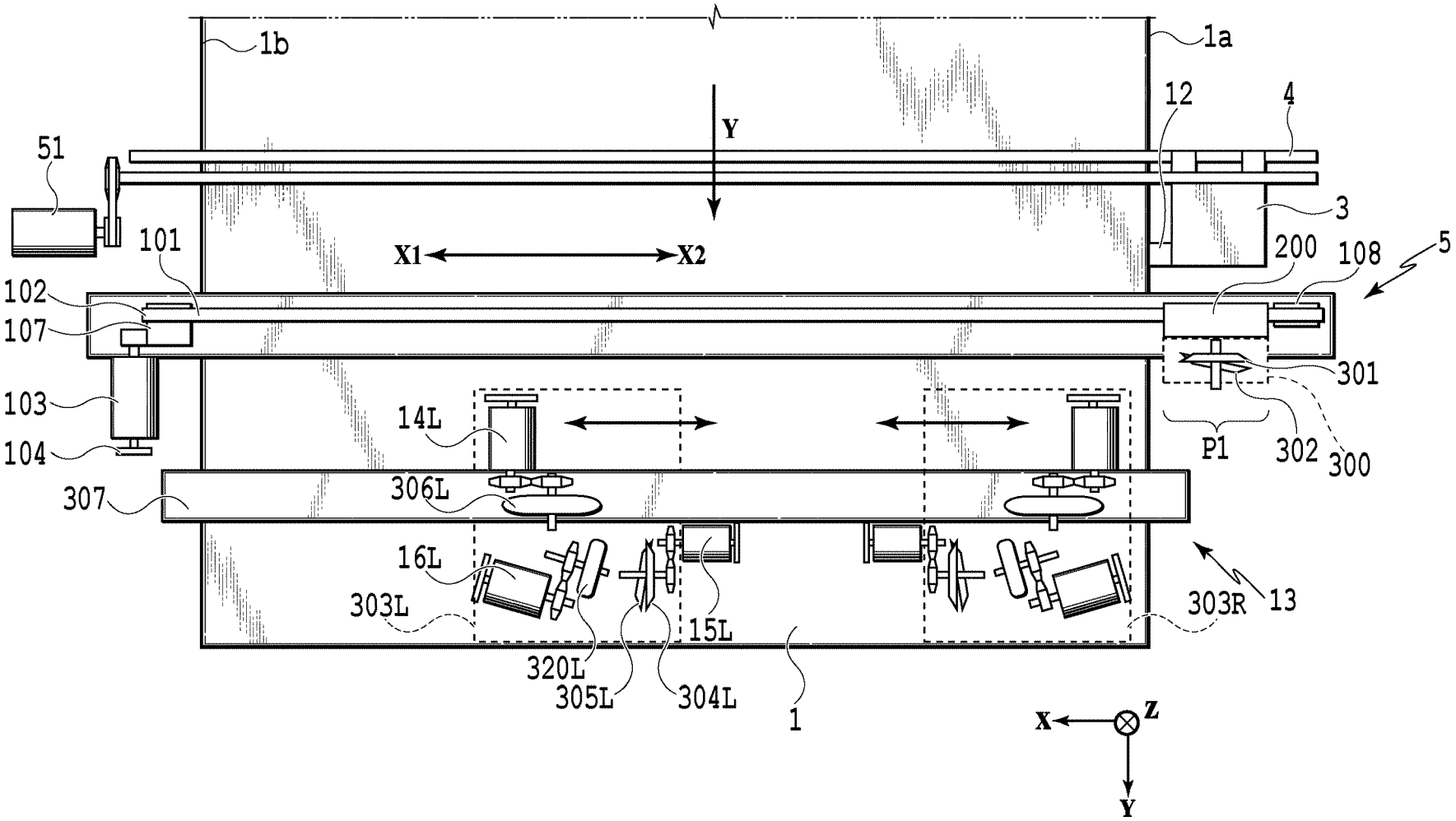
FIG. 2 is a diagram for explaining a cutter and a slitter.

FIG. 2 is a top view for explaining the cutter 5 and the slitter 13 including the slitter units 303L and 303R. In the present specification, "L" and "R" at the end of the reference signs indicate a member on the left side (that is, +X side) and a member on the right side (that is, −X side) on the drawings, respectively. In the present specification, such an end of a reference sign may be omitted in a case of members that are the same on the left side and the right side.

The guide rail 101 is configured to guide the cutter carriage 200 in the direction intersecting the conveyance direction of the roll sheet 1. The cutter carriage 200 integrally connects the cutter unit 300 and the belt 102. Furthermore, the belt 102 is configured to bridge the motor pulley 107 and the tensioner pulley 108 disposed on the left and right sides of the guide rail 101 and is configured to be moved by the cutter motor 103 connected to the motor pulley 107. The cutter motor 103 is provided with the cutter encoder 104. The cutter encoder 104 counts the number of pulses corresponding to driving of the cutter motor 103. Based on the origin position of the cutter carriage 200 and the number of pulses obtained by the cutter encoder 104, it is possible to control the movement position of the cutter unit 300 in the X1 and X2 directions.

The cutter unit 300 includes the upper movable blade 301 and the lower movable blade 302, so that the roll sheet 1 is cut at the contact point of the upper movable blade 301 and the lower movable blade 302 while the cutter unit 300 moves in the X1 direction. Furthermore, the upper movable blade 301 and the lower movable blade 302 are connected to the cutter motor 103 via the belt 102 and the cutter carriage 200 and are configured to be rotationally driven. In a case where the roll sheet 1 is cut, the roll sheet 1 is cut while the lower movable blade 302 and the upper movable blade 301, which is in contact with the lower movable blade 302, rotate together. In the example of FIG. 2, the cutter unit 300 performs cutting from the first end 1*a* of the roll sheet 1 to the second end 1*b* of the roll sheet 1. The first end 1*a* of the roll sheet 1 is an end on the stand-by position P1 side of the cutter unit 300. After the roll sheet 1 is cut, the cutter carriage 200 is reversed at a predetermined reversing position. Further, the cutter carriage 200 moves to a position that is the stand-by position P1 to stand by for the next cutting operation. Although the cutter unit 300 is mounted on the cutter carriage 200 in the example of the present embodiment, the cutter unit 300 may be mounted on the carriage 3 that moves the print head 2, etc., for example.

The slitter 13 is disposed on the downstream side relative to the cutter 5 in the conveyance direction of the roll sheet 1. A slitter unit 303 of the slitter 13 is movable to a given position in the X1 and X2 directions and is capable of cutting the roll sheet 1 in a direction parallel to the conveyance direction (+Y direction). In the present embodiment, an explanation is given of the configuration in which two slitter units 303 are mounted. That is, an explanation is given of the example in which the slitter units 303L and 303R are mounted. The slitter units 303L and 303R have the same configuration with the components that are left-right reversals in the X1 and X2 directions. In FIG. 2, for the sake of simplification, reference signs are mainly assigned to the components of the slitter unit 303L. Therefore, in the following explanation, the slitter unit 303L (first slitter unit) is explained in detail. Detailed explanations of the slitter unit 303R (second slitter unit) are basically omitted, and the aspects different from the slitter unit 303L are explained, as appropriate.

Figure 3A:
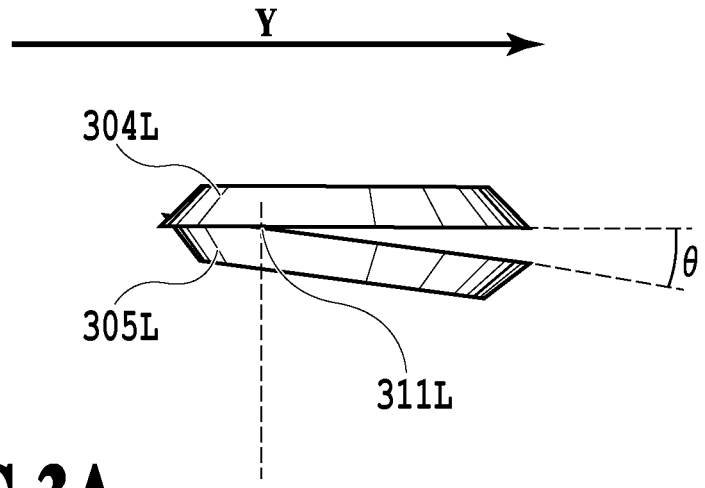
FIGS. 3A and 3B are diagrams illustrating a relationship, etc., between a slitter upper movable blade and a slitter lower movable blade.
Figure 3B:
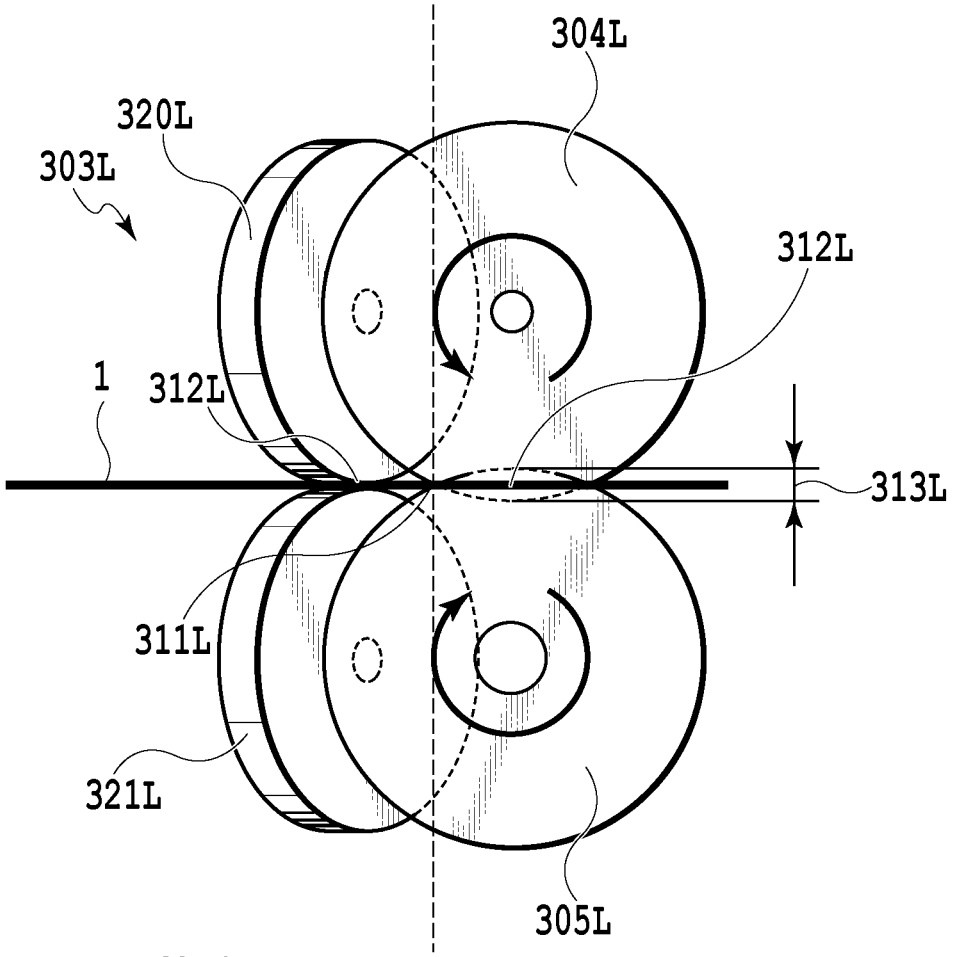
Figure 4:
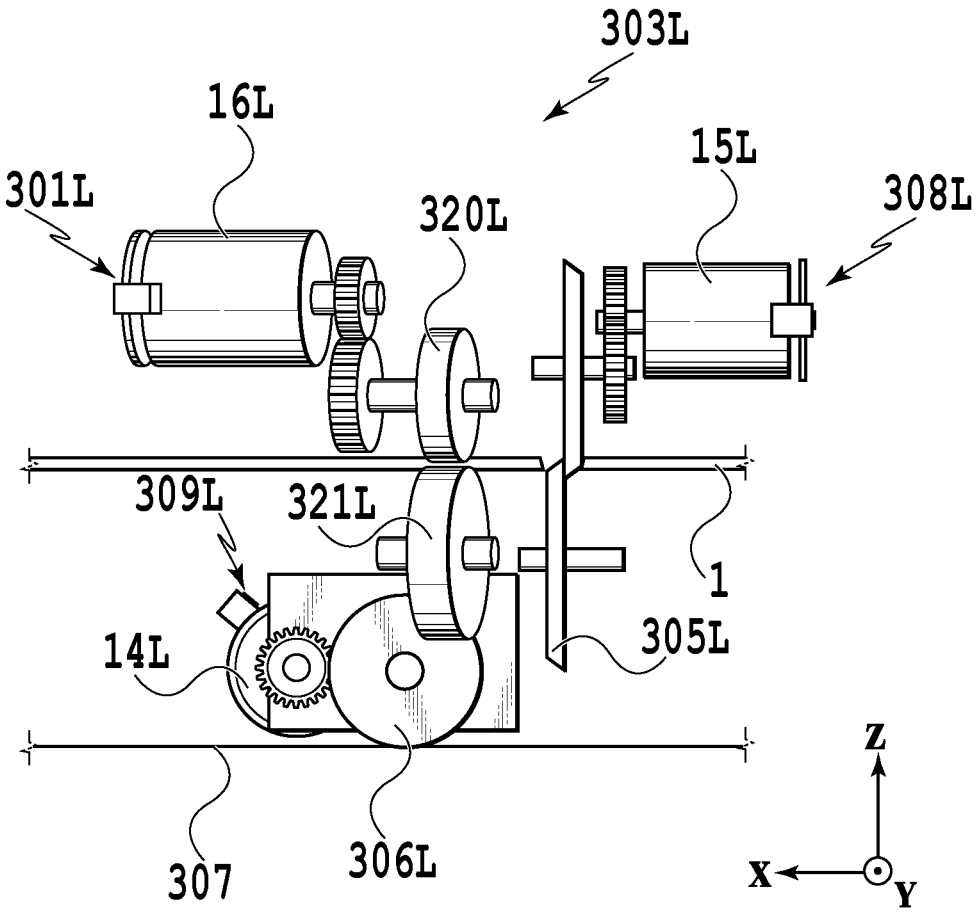
FIG. 4 is a diagram for explaining a slitter unit.

FIG. 3A through FIG. 4 are diagrams for explaining details of the slitter unit 303L. FIG. 3A is a schematic plan view of the slitter upper movable blade 304L and the slitter lower movable blade 305L of the slitter unit 303L. FIG. 3B is a schematic side view of the slitter upper movable blade 304L, the slitter lower movable blade 305L, the slitter upper conveyance roller 320L, and the slitter lower conveyance roller 321L of the slitter unit 303L. FIG. 4 is a front view of the slitter unit 303L.

The slitter unit 303L includes the slitter upper movable blade 304L and the slitter lower movable blade 305L. The slitter upper movable blade 304L and the slitter lower movable blade 305L are disposed so as to have a round blades overlap amount 313L in the vertical direction (Z direction) and have a predetermined amount of angle (intersect angle) θ relative to the conveyance direction (+Y direction), which is the cutting direction. The roll sheet 1 is cut at the contact point 311L of the slitter upper movable blade 304L and the slitter lower movable blade 305L.

The slitter upper movable blade 304L is connected to the slitter movable blade driving motor 15L via a gear. Furthermore, although omitted in the drawings, the slitter lower movable blade 305L is also connected to the slitter movable blade driving motor 15L via a gear. The slitter upper movable blade 304L and the slitter lower movable blade 305L respectively rotate in opposite directions. The slitter upper movable blade 304L and the slitter lower movable blade 305L may be configured to be driven by different driving sources. Since the slitter movable blade driving motor 15L is provided with the slitter movable blade driving encoder 308L, it is possible to control the slitter upper movable blade 304L and the slitter lower movable blade 305L at a predetermined rotation speed and a predetermined rotation amount. That is, in the slitter unit 303L, the roll sheet 1 is cut at the contact point 311L while the slitter upper movable blade 304L and the slitter lower movable blade 305L are driven by the slitter movable blade driving motor 15L to rotate together. In a slitter unit 303 of the present embodiment, the slitter upper movable blade 304 and the slitter lower movable blade 305 function as a cutting unit that cuts a printing medium.

Each of the slitter upper conveyance roller 320L and the slitter lower conveyance roller 321L is positioned on the outer side of the roll sheet 1 in the X direction, compared to the slitter upper movable blade 304L and the slitter lower movable blade 305L. The outer side of the roll sheet 1 is directed to the second end 1*b* of the roll sheet 1, that is, to the region where the image to be recorded as a product is not printed. The slitter upper conveyance roller 320L is connected to the slitter roller driving motor 16L via a gear. Since the slitter roller driving motor 16L is provided with the slitter roller driving encoder 310L, it is possible to control the slitter roller driving motor 16L with a predetermined rotation speed and a predetermined rotation amount. The slitter roller driving motor 16L is controlled to drive at a driving amount (specifically, a rotation speed and a rotation amount), which is synchronized with and corresponding to the conveyance amount by the conveyance roller 8.

The outer peripheral surface of the slitter upper conveyance roller 320L is in contact with the outer peripheral surface of the slitter lower conveyance roller 321L at the roller nip point 312L. The roller nip point 312L of a pair of rollers, that is, a slitter upper conveyance roller 320 and a slitter lower conveyance roller 321, is positioned on the upstream side relative to the contact point 311L in the conveyance direction, as illustrated in FIG. 3B. Accordingly, since the slitter lower conveyance roller 321L is driven together with the slitter upper conveyance roller 320L by friction transmission, the roll sheet 1 is conveyed by the slitter upper conveyance roller 320L and the slitter lower conveyance roller 321L. In a slitter unit 303 of the present embodiment, the slitter upper conveyance roller 320 and the slitter lower conveyance roller 321 function as a conveying portion that conveys a printing medium. Therefore, in the slitter unit 303L, the roll sheet 1 is cut by the slitter upper movable blade 304L and the slitter lower movable blade 305L in the conveyance direction while the roll sheet 1 is conveyed by the slitter upper conveyance roller 320L and the slitter lower conveyance roller 321L.

Figure 5:
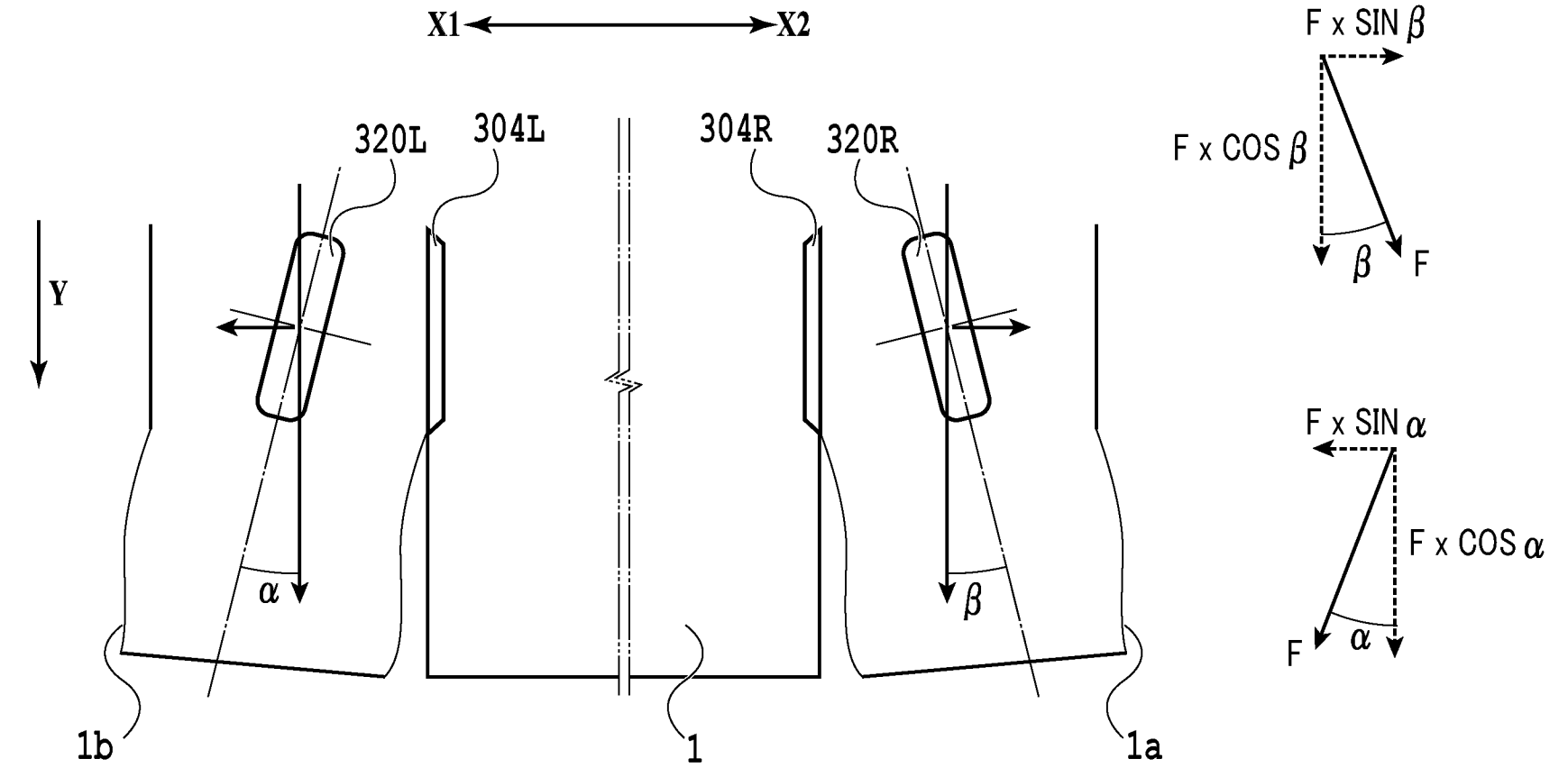
FIG. 5 is a diagram for explaining tilts of slitter upper conveyance rollers and slitter lower conveyance rollers.

Here, with reference to FIG. 5, the slitter upper conveyance rollers 320 and the slitter lower conveyance rollers 321 are further explained in detail. FIG. 5 is a schematic plan view of the vicinity of slitter upper conveyance rollers 320L and 320R in the slitter units 303L and 303R.

In the slitter unit 303L, the slitter upper conveyance roller 320L and the slitter lower conveyance roller 321L are arranged to be tilted at the angle α in the X1 direction relative to the Y direction, so that the downstream sides of the slitter upper conveyance roller 320L and the slitter lower conveyance roller 321L in the conveyance direction are further to the X1 side. Accordingly, the roll sheet 1 is conveyed at an angle slightly toward one side (X1 direction side) relative to the Y direction by the slitter upper conveyance roller 320L and the slitter lower conveyance roller 321L. Furthermore, in the slitter unit 303R, the slitter upper conveyance roller 320R and the slitter lower conveyance roller 321R are arranged to be tilted at the angle β in the X2 direction relative to the Y direction, so that the downstream sides of the slitter upper conveyance roller 320R and the slitter lower conveyance roller 321R in the conveyance direction are further to the X2 side. Accordingly, the roll sheet 1 is conveyed at an angle slightly toward the other side (X2 direction side) relative to the Y direction by the slitter upper conveyance roller 320R and the slitter lower conveyance roller 321R.

With such a configuration, conveying force having a conveyance direction component and a width direction component is applied to the conveyed roll sheet 1 by the slitter units 303L and 303R. Furthermore, tensional force is generated by the width direction component, so that the roll sheet 1 is pulled toward the both sides in the X direction. For example, in a case where the conveying force generated by a slitter upper conveyance roller 320 and a slitter lower conveyance roller 321 is F, the component force in the Y direction of the slitter units 303L and 303R are F×COSα and F×COSβ, respectively. Furthermore, the component force in the X direction are F×SINα and F×SINβ, respectively. Therefore, with increase in the angles α and β, the component force in the Y direction, that is, the conveyance direction component of the conveying force, is reduced, and the component force in the X direction, that is, the width direction component of the conveying force is increased. The angles α and β may be the same tilt angle or different tilt angles. Furthermore, for example, the angles α and β are obtained by an experiment and set to such angles that the roll sheet 1 can be conveyed while the flatness of the roll sheet 1 including the leading edge is ensured at a timing where the roll sheet 1 is cut by the slitter upper movable blades 304 and the slitter lower movable blades 305.

As illustrated in FIG. 4, the slitter unit 303L includes the slitter moving motor 14L and is configured such that driving force is transmitted to the slitter moving roller 306L via a gear. The slitter moving roller 306L abuts on the slitter guide rail 307, which extends in the X direction. Furthermore, the slitter unit 303L is configured to be movable in the X1 direction and the X2 direction by friction between the outer peripheral surface of the slitter moving roller 306L and the slitter guide rail 307. The slitter moving motor 14L is provided with the slitter moving encoder 309L, so that it is possible to control the movement position of the slitter unit 303L from the stand-by position P1.

Each of the components in the slitter unit 303L is held by a holding member, which is not illustrated in the drawings. Accordingly, the slitter upper movable blade 304L, the slitter lower movable blade 305L, the slitter upper conveyance roller 320L, and the slitter lower conveyance roller 321L are integrally movable along the slitter guide rail 307. Although the slitter moving roller 306L is driven with friction in the present embodiment, the slitter moving roller 306L may have a rack and pinion configuration with a slitter moving roller serving as a pinion and a slitter guide rail serving as a rack. In the present embodiment, the slitter moving motor 14L, the slitter moving roller 306L, the slitter guide rail 307, etc., function as a moving portion for moving the slitter unit 303L in the X direction.

Figure 6:
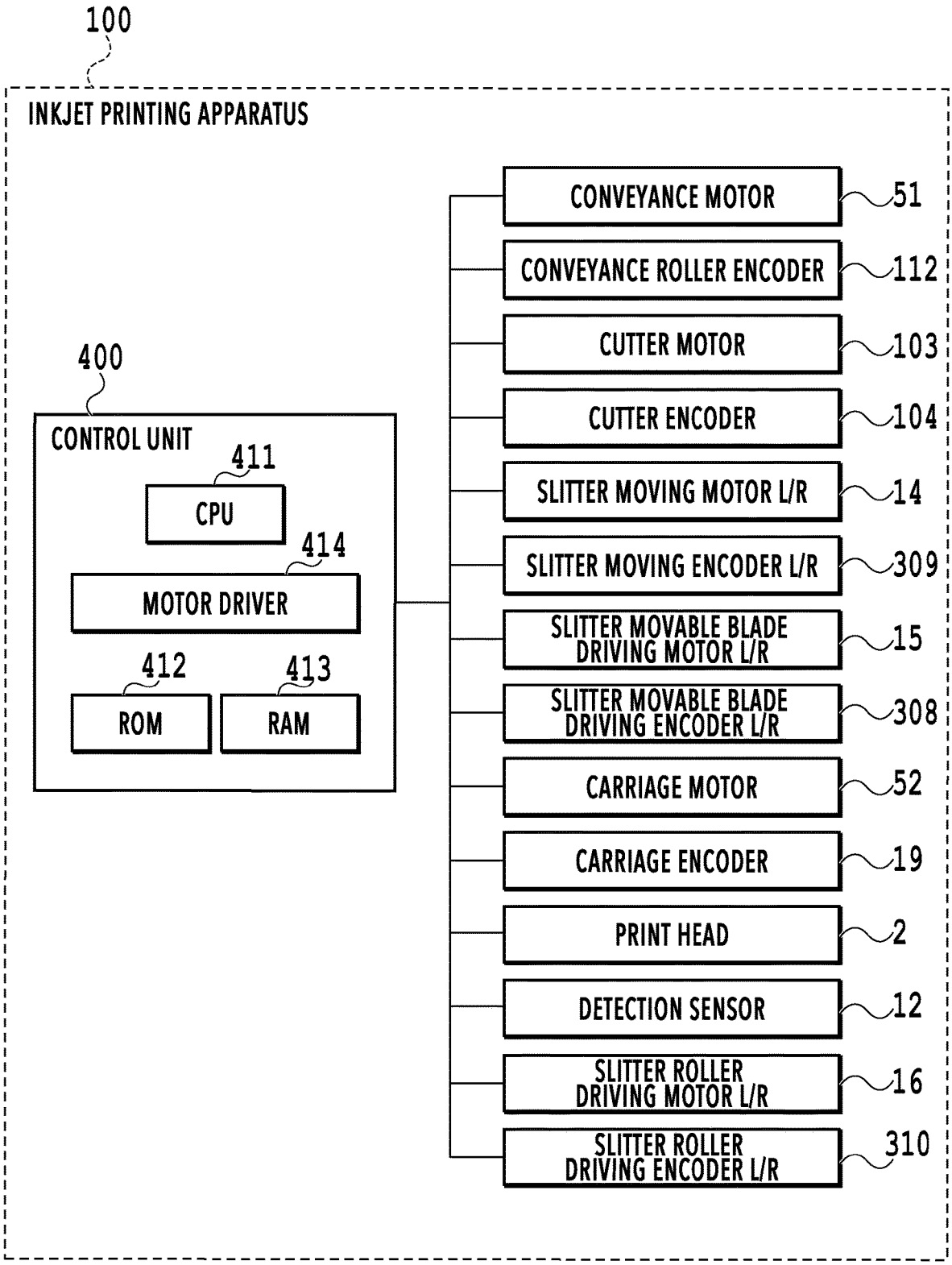
FIG. 6 is a block configuration diagram of a control system of the printing apparatus.

FIG. 6 is a schematic block diagram illustrating a control configuration of the printing apparatus 100. The printing apparatus 100 includes a control unit 400. Furthermore, the control unit 400 includes a CPU 411, a ROM 412, a RAM 413, and a motor driver 414. The control unit 400 implements control of a conveyance motor 51, a cutter motor 103, a slitter moving motor 14, a slitter movable blade driving motor 15, a carriage motor 52, a print head 2, and a slitter roller driving motor 16. The control unit 400 obtains signals from a conveyance roller encoder 112, a cutter encoder 104, a slitter moving encoder 309, and a slitter movable blade driving encoder 308. Furthermore, the control unit 400 obtains signals from a carriage encoder 19, a detection sensor 12, and a slitter roller driving encoder 310. Moreover, the control unit 400 controls the various motors and the print head 2, based on the signals.

The printing apparatus 100 is configured such that the slitter 13 is capable of cutting a predetermined region of the width (X direction) of the roll sheet 1 after printing is performed on the roll sheet 1. Therefore, in the printing apparatus 100, for example, by cutting the region adjacent in the width direction to the image to be recorded as a product by use of the slitter 13, it is possible to obtain such a printed subject as obtained in a case where left-right borderless printing is performed by a printing apparatus that is not provided with the slitter 13. In this case, since it is not necessary to apply ink such that the ink is ejected outside the roll sheet 1, it is possible to greatly prevent the ink from adhering to the platen 10. Hereinafter, an explanation is given of the case in which borderless printing in the left and right direction, that is, the X direction, is performed by the printing apparatus 100 on the roll sheet 1.

In a case where an instruction for starting left-right borderless printing on the roll sheet 1 is provided by a user, first, the slitter moving motors 14L and 14R are driven, so as to move the slitter units 303L and 303R to cutting positions, respectively. The cutting positions of the slitter upper movable blades 304 and the slitter lower movable blades 305 are, for example, the positions of the end portions in the X direction of the region where the image to be recorded as a product is printed.

Next, the conveyance motor 51 and the slitter roller driving motors 16 are driven such that the conveyance speed of the conveyance roller 8 and the conveyance speed of the slitter upper conveyance rollers 320 and the slitter lower conveyance rollers 321 are the same speed, so that the roll sheet 1 is conveyed by the conveyance roller 8. Furthermore, the slitter movable blade driving motors 15 are driven to rotate the slitter upper movable blades 304 and the slitter lower movable blades 305. Thereafter, in a case where it is detected that the leading edge of the roll sheet 1 has been conveyed up to the printing start position, based on a detection result of a sensor (not illustrated in the drawing), printing on the roll sheet 1 is performed based on print data.

With progress in the printing, in a case where the leading edge of the roll sheet 1 reaches the roller nip points 312 of the slitter upper conveyance rollers 320 and the slitter lower conveyance rollers 321, the roll sheet 1 is conveyed in the Y direction while being pulled in the X direction. Accordingly, the roll sheet 1 is conveyed while the region where the image to be a product is printed is pulled in the X1 direction and the X2 direction. Thereafter, in a case where the leading edge of the roll sheet 1 reaches the contact points 311 of the slitter units 303, the roll sheet 1 is cut by the slitter upper movable blades 304 and the slitter lower movable blades 305 that are rotating.

Figure 7A:
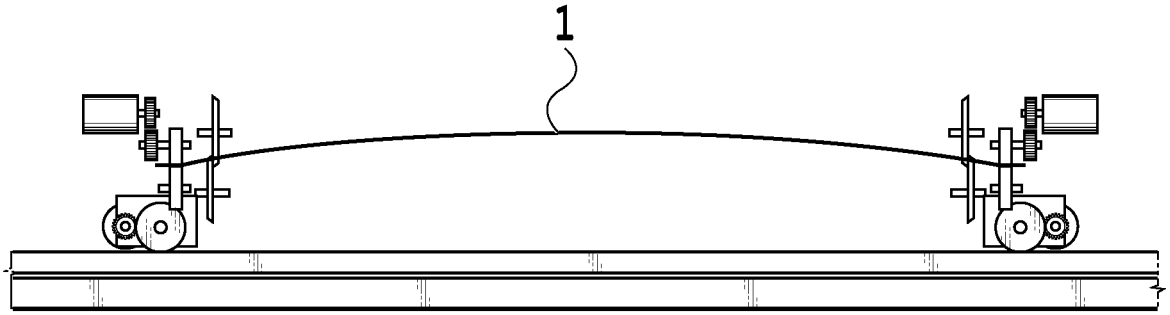
FIGS. 7A and 7B are diagrams for explaining the flatness of a roll sheet.
Figure 7B:
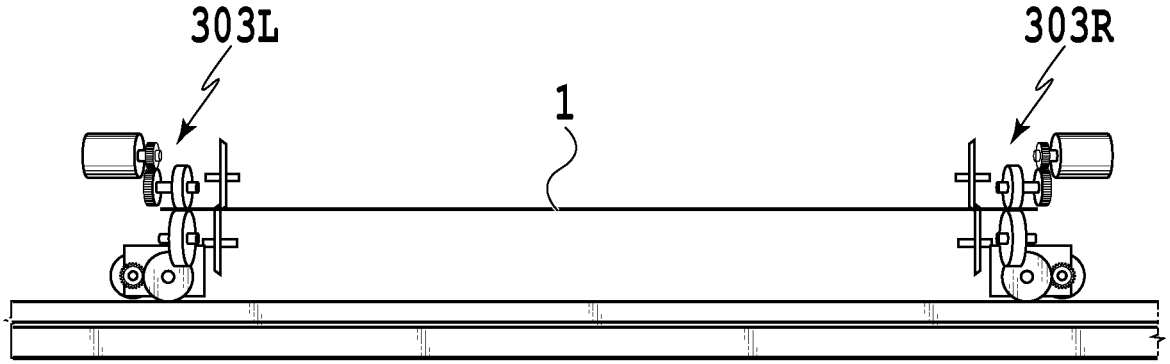

Here, FIG. 7A is a front view in a case where the roll sheet 1 is conveyed by the slitter upper conveyance rollers 320 and the slitter lower conveyance rollers 321 in parallel to the Y direction. FIG. 7B is a front view in a case where the roll sheet 1 is conveyed by the slitter upper conveyance rollers 320 and the slitter lower conveyance rollers 321 in tilted directions relative to the Y direction.

As illustrated in FIG. 7A, if the roll sheet 1 is conveyed by the pairs of rollers in parallel to the conveyance direction, the middle part of the roll sheet 1 between the two held locations floats in a case where cockling of the roll sheet 1 occurs due to application of ink. The held locations are the roller nip points between the pairs of rollers on the left and right. In this state, in a case where the leading edge of the roll sheet 1 reaches the contact points 311, the positions of the leading edge corresponding to the contact points 311 deviate from ideal positions, which results in occurrence of deviation in cutting in the vicinity of the leading edge. Furthermore, at a timing where the roll sheet 1 reaches the contact points 311 to be cut, the resistance for cutting is particularly high at the leading edge. Therefore, for example, in a case where a printing medium with low rigidity, such as ordinary paper or thin coated paper, is used as the roll sheet 1, the leading edge of the printing medium is easily deformed. Thus, in a case where the roll sheet 1 is cut at the contact points 311 in such a state where the leading edge of the roll sheet 1 floats as illustrated in FIG. 7A, the cutting lines (slits) may not become linear and the quality may be deteriorated.

As illustrated in FIG. 7B, in the slitter units 303 of the present embodiment, the roll sheet 1 is conveyed in such a manner that the roll sheet 1 is pulled by the slitter upper conveyance rollers 320 and the slitter lower conveyance rollers 321 in the X1 direction and the X2 direction. Accordingly, at a timing where the roll sheet 1 reaches the contact points 311, which are positioned on the downstream side relative to the roller nip points 312 in the conveyance direction, the leading edge of the roll sheet 1 is in such a state where the flatness is ensured. Therefore, since the orientations of the leading edge of the roll sheet 1 at the contact points 311 are stabilized, it is possible to prevent the positions of the leading edge corresponding to the contact points 311 from deviating and prevent deformation of the leading edge at a timing of cutting. Thus, as for the roll sheet 1 that is cut by the slitter units 303, the cutting accuracy is stabilized since, at the leading edge, occurrence of deviation in cutting and quality deterioration of the cutting lines are prevented. In this way, the slitter units 303 on the left and right pull the roll sheet 1 outward to generate tensional force in the X direction. Therefore, it is preferred that the roller nip points 312 of the slitter upper conveyance rollers 320 and the slitter lower conveyance rollers 321 are positioned as close to the contact points 311 of the slitter upper movable blades 304 and the slitter lower movable blades 305 as possible in the X direction.

Upon completion of the printing, cutting by the slitter units 303 is performed up to predetermined positions. Thereafter, the slitter units 303L and 303R are moved to the respective stand-by positions, and the roll sheet 1 is conveyed up to a position where the cutter unit 300 can cut the roll sheet 1. Then, the roll sheet 1 is cut by the cutter unit 300. Accordingly, the printed subject of the roll sheet 1, on which the image to be recorded as a product has been printed, and the cut pieces, on which the image is not printed, are discharged through the discharging guide 11.

As explained above, in a slitter unit 303 of the printing apparatus 100, the roller nip point 312 for nipping and conveying the roll sheet 1 is positioned on the upstream side in the conveyance direction relative to the contact point 311 for cutting the roll sheet 1. Furthermore, regarding the left and right slitter units 303 of the present embodiment, the roll sheet 1 is conveyed in such a manner that tensional force is generated by the slitter upper conveyance rollers 320 and the slitter lower conveyance rollers 321 in the X direction.

Accordingly, even though the roll sheet 1 floats due to cockling or even though the roll sheet 1 is a printing medium with low rigidity, it is possible to ensure the flatness of the roll sheet 1 at a timing where the roll sheet 1 reaches the contact points 311. Therefore, it is less likely that the cut positions to be cut by the slitter 13 at the leading edge of the roll sheet 1 deviate in the width direction.

Other Embodiments

The above-described embodiment may be modified as shown in the following (1) through (6).

(1) In the slitter units 303L and 303R of the above-described embodiment, the slitter upper conveyance rollers 320 and the slitter lower conveyance rollers 321 are arranged to be tilted at the angle α and the angle β relative to the Y direction, respectively. However, the above-described embodiment is not limited thereto. That is, there may be a configuration in which each of the angle α of the slitter unit 303L and the angle β of the slitter unit 303R can be adjusted. In this case, the slitter units 303 are provided with an adjusting mechanism for adjusting the angles of a slitter upper conveyance roller 320 and a slitter lower conveyance roller 321. Furthermore, based on information such as the type of printing medium, the surrounding environment, and the printing duty, the control unit 400 controls the adjusting mechanism to adjust the angle α and the angle β. There may be a configuration in which the adjustment can be performed by a user.

The control unit 400 controls the adjusting mechanism, based on a table in which a condition and an angle are associated with each other, such that, for example, the angle α and the angle β have larger values in a condition where the leading edge of the roll sheet 1 floats more. That is, in this form, the adjusting mechanism functions as an adjusting unit that adjusts the angles α and β of a slitter upper conveyance roller 320 and a slitter lower conveyance roller 321, which are tilted relative to the Y direction. Furthermore, the control unit 400 functions as a control unit that controls the angles α and β via the adjusting mechanism, based on information such as the type of printing medium.

As for the angles α and β, the larger the values are, the more likely a slip will occur between the rollers and the printing medium. If the slip occurs, the rollers are worn and problems such as reduction in the conveying force occur. Therefore, it is preferred that the angles α and β are at least such angles that can ensure the cutting accuracy. For example, it is preferred that the angles α and β are set to large values in a case of ordinary paper or coated paper, on which cockling easily occurs due to application of ink. Furthermore, as for the surrounding environment, in a low-temperature and low-humidity environment, it is likely that the printing medium curls and floats even in a case of a high printing duty. Under such conditions, it is also preferred that the angles α and β are set to large values. The conditions for adjusting the angles α and β are not limited to the type of printing medium, the surrounding environment, and the printing duty. That is, any kinds of condition that may cause floating of the printing medium are possible. Furthermore, the angles α and β may be adjusted based on multiple conditions out of the above-described conditions.

(2) In the above-described embodiment, the slitter upper conveyance rollers 320 and the slitter upper movable blades 304 are driven by different driving sources. However, the above-described embodiment is not limited thereto. That is, a slitter upper conveyance roller 320 and a slitter upper movable blade 304 may be configured to move together by use of a joint, or the like, or may be configured such that the driving force can be transmitted from one component to the other component by use of a helical gear. Accordingly, it is possible to reduce the number of driving sources and realize cost saving.

(3) In the above-described embodiment, the slitter 13 includes two slitter units 303. However, only one slitter unit 303 or more than three slitter units 303 may be included. Furthermore, in the above-described embodiment, the slitter unit 303L conveys the roll sheet 1 at an angle in the X1 direction relative to the Y direction and the slitter unit 303R conveys the roll sheet 1 at an angle in the X2 direction relative to the Y direction. However, the above-described embodiment is not limited thereto. That is, one of the slitter units 303 may convey the roll sheet 1 at an angle relative to the Y direction and the other one of the slitter units 303 may convey the roll sheet 1 in parallel to the Y direction. Furthermore, in the above-described embodiment, the slitter units 303 are configured to be movable in the width direction. However, the above-described embodiment is not limited thereto. That is, the slitter units 303 may be fixedly arranged. Furthermore, in the slitter 13 of the above-described embodiment, two round blades are rotated in opposite directions to cut a conveyed printing medium. However, the above-described embodiment is not limited thereto. That is, as for the mechanism for cutting a printing medium in the slitter 13, various publicly known technologies that are capable of cutting a conveyed printing medium may be used, such as a configuration in which a blade portion and a cutter are fixedly arranged to cut a conveyed printing medium.

(4) In the slitter units 303 on the left and right of the above-described embodiment, the slitter upper conveyance rollers 320 and the slitter lower conveyance rollers 321 convey a printing medium while generating tensional force in the X direction. However, the above-described embodiment is not limited thereto. That is, as a conveyance mechanism of the slitter units 303 to convey a printing medium, various publicly known technologies may be applied to any configuration that is capable of conveying a printing medium in the Y direction while generating tensional force in the X direction for the printing medium.

(5) In the above-described embodiment, the explanation has been given with the example of what is termed as a serial scan type printing apparatus, in which a print head is moved in the X direction and a printing medium is moved in the Y direction. However, what is termed as a full-line type printing apparatus, in which ink is ejected across the width direction of a printing medium, may be used. Furthermore, although not particularly described in the above embodiment, as for the configurations of the slitter units 303 for cutting a printing medium and moving in the X direction, various publicly known technologies may be used. Furthermore, in the above-described embodiment, printing is performed by the printing apparatus 100 in an ink jet system. However, the printing strategy of the printing apparatus 100 may be any of various publicly known printing strategies.

(6) The above-described embodiment and various forms shown in (1) through (5) may be combined as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-065976, filed Mar. 29, 2019, which is hereby incorporated by reference wherein in its entirety.

What is claimed is:

1. A printing apparatus comprising:

a conveyance unit configured to convey a printing medium in a conveyance direction;

a printing unit configured to print an image on the printing medium that is conveyed by the conveyance unit;

a cutting unit configured to cut the printing medium, which is conveyed by the conveyance unit, along the conveyance direction; and a conveying force apply unit arranged on an outer side relative to the cutting unit in a width direction of the printing medium and configured to nip the printing medium and apply a conveying force to the printing medium, wherein the printing medium is cut by the cutting unit while being conveyed by the conveyance unit and while the conveying force is applied to the printing medium by the conveying force apply unit, and wherein the conveying force apply unit is configured to apply the conveying force to the printing medium in a direction outward in the width direction from an upstream to a downstream of the conveyance direction.

2. The printing apparatus according to claim 1, wherein the conveying force apply unit is arranged on an upstream side in the conveyance direction relative to a position where the cutting unit cuts the printing medium.

3. The printing apparatus according to claim 1, wherein the conveying force apply unit is configured to apply a conveying force including a conveyance direction component and a width direction component to the printing medium, and wherein the width direction component corresponds to a component in such a direction that the printing medium is pulled.

4. The printing apparatus according to claim 1, wherein the conveying force apply unit is configured to nip a region of the width direction in which the image is not printed.

5. The printing apparatus according to claim 1, wherein the conveying force apply unit includes a pair of rollers, which are arranged to be tilted relative to the conveyance direction and configured to nip and convey the printing medium.

6. The printing apparatus according to claim 1, wherein the conveying force apply unit is arranged to be tilted at such an angle that the conveying force apply unit is capable of applying the conveying force to the printing medium as well as ensuring flatness of the printing medium at a timing where the printing medium reaches a position where the cutting unit cuts the printing medium.

7. The printing apparatus according to claim 1, wherein the cutting unit forms a first slitter unit together with the conveying force apply unit on one side of the width direction and a second slitter unit together with the conveying force apply unit on the other side of the width direction.

8. The printing apparatus according to claim 1, wherein the conveying force apply unit includes an adjusting unit configured to be capable of adjusting a tilt angle.

9. The printing apparatus according to claim 8 further comprising a control unit configured to control the tilt angle via the adjusting unit, based on at least one of information of a type of printing medium, a surrounding environment, and a printing duty.

10. The printing apparatus according to claim 1, wherein the cutting unit is configured to have two round blades in contact with each other, so as to cut the printing medium, and wherein a position where the cutting unit cuts the printing medium corresponds to a contact point where the two round blades are in contact with each other.

11. The printing apparatus according to claim 1, wherein the conveying force apply unit is configured to apply the conveying force to the printing medium in synchronization with the conveyance unit.

12. The printing apparatus according to claim 1 further comprising a cutter configured to cut the printing medium in the width direction.

13. The printing apparatus according to claim 1, wherein the printing unit is configured to perform printing in an ink jet system.

14. A conveyance apparatus comprising:

a conveyance unit configured to convey a printing medium in a conveyance direction;

a cutting unit configured to cut the printing medium, which is conveyed by the conveyance unit, along the conveyance direction; and a conveying force apply unit arranged on an outer side relative to the cutting unit in a width direction of the printing medium and configured to nip the printing medium and apply a conveying force to the printing medium, wherein the printing medium is cut by the cutting unit while being conveyed by the conveyance unit and while the conveying force is applied to the printing medium by the conveying force apply unit, and wherein the conveying force apply unit is configured to apply the conveying force to the printing medium in a direction outward in the width direction from an upstream to a downstream of the conveyance direction.

* * * * *